United States Patent [19]

Messer

[11] Patent Number: 4,813,902

[45] Date of Patent: Mar. 21, 1989

[54] GREETING CARD BLANK, GREETING CARD MADE THEREFROM AND MAILABLE GREETING CARD-BALLOON COMBINATION

[76] Inventor: Richard Messer, 169 Sequoia Rd., Bridgeport, Conn. 06606

[21] Appl. No.: 63,664

[22] Filed: Jun. 19, 1987

[51] Int. Cl.[4] ..... A63H 33/00; A63H 27/10

[52] U.S. Cl. ..... 446/71; 446/222; 446/80; 40/124.1; 40/539

[58] Field of Search ..... 40/124.1, 539, 610; 283/1 R; 446/147, 488, 220, 222, 71, 80; 24/30.5 R, 30.5 S, 573, 574

[56] References Cited

U.S. PATENT DOCUMENTS

| | | | |
|---|---|---|---|
| 2,449,911 | 9/1948 | Roth | 40/124.1 |
| 2,510,883 | 6/1950 | Goldberg | 446/222 X |
| 3,250,241 | 5/1966 | Levy et al. | 446/220 X |
| 3,427,642 | 2/1969 | Mohr | 40/124.1 |
| 3,471,958 | 10/1969 | Westin | 40/124.1 X |

*Primary Examiner*—Mickey Yu

*Attorney, Agent, or Firm*—Richard A. Craig

[57] ABSTRACT

A greeting card blank is made from a piece of card stock and has first and second ends and sides perpendicular thereto. First, second and third fold lines are parallel to the ends, the first end and the first fold line defining a first panel, the first and second fold lines a second panel, the second and third fold lines a third panel and the third fold line and the second end a fourth panel. The first panel has a slot therethrough and a tab projects from the second end and is interengageable with the slot. The blank also has a round hole therethrough on its longitudinal centerline and near the third fold line. The blank is convertible to a self-standing greeting card by folding the blank along the fold lines and inserting the tab into the slot, with the first and fourth panels overlapping each other, the second panel providing a bottom panel and the third panel providing a front panel. The third panel bears a greeting card message. The blank further has a round hole therethrough on the longitudinal centerline of the blank and near or on the third fold line. There are also provided an uninflated balloon having a stem and an open end, a hollow tube and a clip device for securing the inflated balloon to the tube which is insertable into the round hole through the blank, so that the self-standing greeting card furnishes a holder for the balloon.

7 Claims, 3 Drawing Sheets

GREETING CARD BLANK, GREETING CARD MADE THEREFROM AND MAILABLE GREETING CARD-BALLOON COMBINATION

BACKGROUND OF THE INVENTION

This invention relates to a greeting card blank, a greeting card made therefrom and a mailable balloon-greeting card combination. More particularly, the invention relates to such a combination that can be mailed flat in an envelope, to express any type of message conveyable by a greeting card.

The following U.S. patents are mentioned as background prior art, but none of them is pertinent to the invention:

| U.S. Pat. No. | Date | Inventor |
|---|---|---|
| 1,598,828 | September 7, 1926 | Leatherow |
| 2,568,389 | September 18, 1951 | Elliot |
| 2,635,386 | April 21, 1953 | Guischard |
| Des. 266,915 | November 16, 1982 | Metzinger |

Leatherow teaches a toy comprising an inflatable body and a collapsible stand, permanently attached to each other.

Elliot discloses an inflatable globe, wherein the twisted stem of the globe cooperates with incisions formed in a base that is shaped like a truncated cone for holding the globe in position in its inflated condition.

Guischard teaches a doll with a head provided by an inflated balloon.

Metzinger discloses a sculptural air balloon attachment for a gift basket which is fastened to the balloon by wire members.

These prior patents do not suggest the idea of the present invention, namely, combining a balloon with a greeting card, in such a way that they can be mailed flat and then simply assembled by the recipient with the balloon inflated and held by a base member that serves as the greeting card and also serves as a stand for holding the balloon.

Accordingly, it is an important object of the invention to provide a stand member that serves the dual functions of being a greeting card and a holder for a balloon.

It is a further object to provide a flat blank that bears a greeting card message and that is readily convertible by the recipient into such a balloon holder.

It is an additional object to provide such a flat blank that is generally rectangular so as to fit readily in a standard shaped mailing envelope.

It is another object to provide accessory items, comprising a straw and a clip, that can also fit into the standard shaped mailing envelope.

It is yet a further object to provide an inflatable balloon, a flat blank bearing a greeting card message, a hollow tube such as a drinking straw and clip means, all of which fit in the standard shaped envelope, the parts together being sufficiently light in weight that no excess postage is required.

A still additional object is to provide the foregoing parts that are economical to manufacture and yet are capable of ready and rapid assembly into an attractive finished product.

Additional objects and advantages will appear hereinafter.

SUMMARY OF THE INVENTION

The invention includes a greeting card blank made from a piece of card stock having first and second ends and sides perpendicular thereto. First, second and third fold lines are parallel to the ends, the first end and the first fold line defining a first panel, the first and second fold lines a second panel, the second and third fold lines a third panel and the third fold line and the second end a fourth panel. The first panel has a slot therethrough and a tab projects from the second end and is interengageable with the slot. The blank also has a round hole therethrough on its longitudinal centerline and near the third fold line. The blank is convertible to a self-standing greeting card by folding the blank along the fold lines and inserting the tab into interengagement with the slot, with the first and fourth panels overlapping each other, the second panel providing a bottom panel and the third panel providing a front panel and also bearing a greeting card message.

There are also provided an uninflated balloon with a steam and an open end, a hollow tube, and clip means, so that the balloon can be inflated and a knot tied in its stem, after which the clip means can be brought into holding engagement with the balloon stem and with the hollow tube and the hollow tube can thereupon be inserted through the hole in the self-standing greeting card, so that the self-standing greeting card furnishes a holder for the balloon.

The blank, the uninflated balloon, the tube and the clip means can be mailed in a standard shaped envelope without requiring excess postage.

DESCRIPTION OF THE INVENTION

Figure 1:
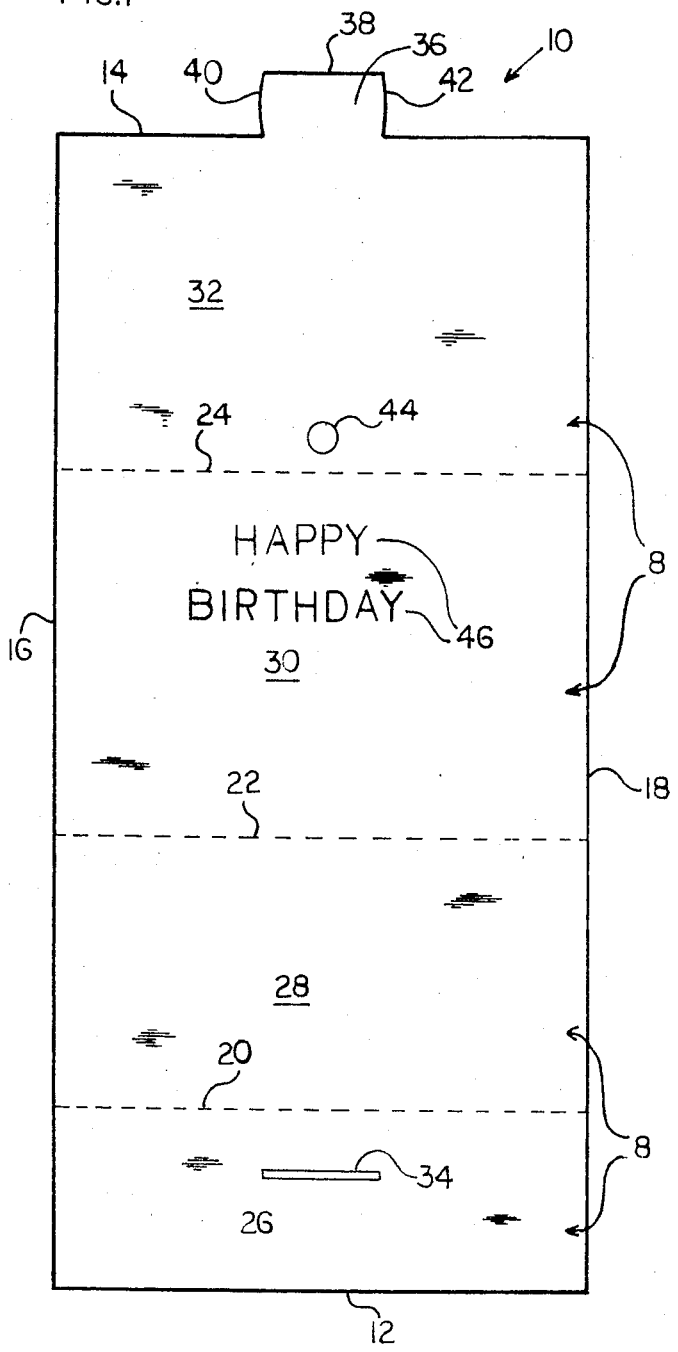
FIG. 1 is a flat front plan view of a greeting card blank that is a preferred embodiment of the invention.

FIG. 1 shows, in flat front plan, a front face 8 of a greeting card blank 10 that is a preferred embodiment of the invention. Blank 10 comprises a generally rectangular piece of card stock having parallel first and second ends 12 and 14, respectively, parallel first and second sides 16 and 18, respectively, perpendicular to ends 12 and 14, and three fold lines 20, 22 and 24 parallel to ends 12 and 14 and extending between sides 16 and 18.

The length of blank 10 between ends 12 and 14 is about 9.625 inches (24.4 cm) and the width between sides 16 and 18 is about 4.75 inches (12.1 cm). Fold line 20 is about 1.5 inches (3.8 cm) from end 12, fold line 22 is about 2.3125 inches (5.9 cm) from fold line 20 and fold line 24 is about 3.0625 inches (7.8 cm) from fold line 22, or 2.75 inches (7.0 cm) from end 14.

Fold lines 20, 22 and 24 provide blank 10 with a panel 26 between end 12 and fold line 20, a panel 28 between fold lines 20 and 22, a panel 30 between fold lines 22 and 24 and a panel 32 between fold lines 24 and end 14.

Blank 10 further has, through panel 26, a slot 34 having a length, parallel to end 12, of about 0.875 inch (2.2 cm) and spaced about 0.375 inch (1.0 cm) from fold line 20. Slot 34 is centered on the longitudinal centerline of blank 10.

Also centered on the longitudinal centerline of blank 10 and projecting from end 14 is a tab 36 having a longitudinal edge 38 parallel to end 14 and spaced about 0.5 inch (1.3 cm) from end 14 and convex lateral edges 40 and 42 joining edge 38 and end 14. The maximum spacing between edges 40 and 42 is marginally greater than the length of slot 34, which, as stated, is about 0.875 inch (2.2 cm).

Finally, blank 10 has therethrough, in panel 32 and on the longitudinal centerline of blank 10, a circular hole 44 about 0.25 inch (0.6 cm) in diameter and centered about 0.1875 inch (0.5 cm) from fold line 24.

Figure 6:
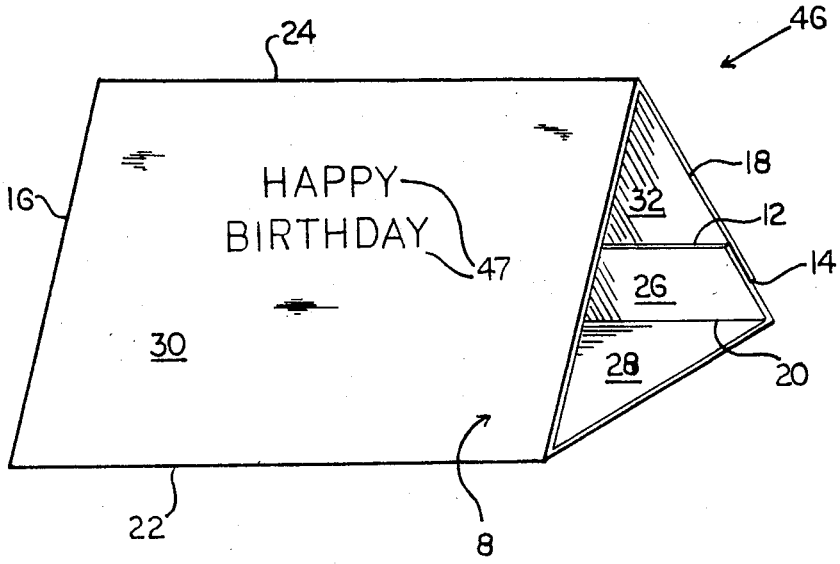
FIG. 6 is a front perspective view of an assembled greeting card formed from the blank of FIG. 1.
Figure 7:
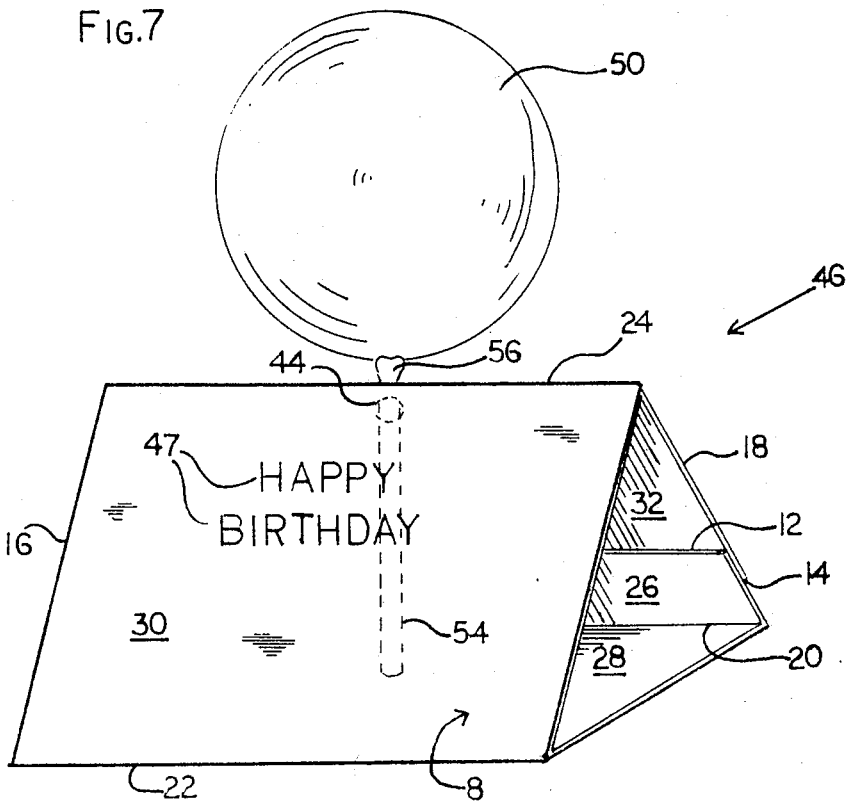
FIG. 7 is a view similar to FIG. 6 but also showing the balloon inflated and assembled with the hollow tube and the clip means, the greeting card serving as a stand holding the balloon.

Greeting card blank 10 is readily convertible into a self-standing greeting card 46, as shown in FIGS. 6 and 7, by folding blank 10 about fold lines 20, 22 and 24 with front face 8 on the outside, to bring panel 32 into overlapping relationship with panel 26, and inserting tab 36 through slot 34, in interengaging relationship therewith.

Greeting card 46 is generally triangular, as shown in FIGS. 6 and 7, and has a bottom provided by panel 28, a front provided by panel 30 and a back provided by panels 26 and 32.

Panel 30 is shown bearing a typical greeting card message 47, such as HAPPY BIRTHDAY, which is given only as an example.

Figure 2:
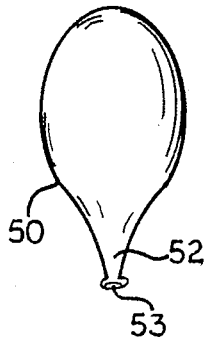
FIG. 2 is a view of an uninflated balloon that is a component of the inventive combination.
Figure 3:
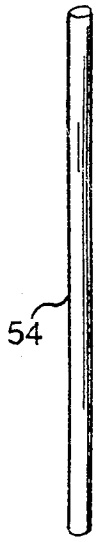
FIG. 3 is a view of a hollow tube that is another component of the inventive combination.
Figure 4:
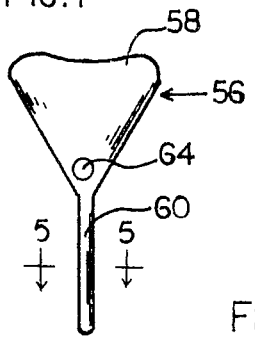
FIG. 4 is a view of a clip member that is a portion of clip means that is a still further component of the inventive combination.
Figure 5:
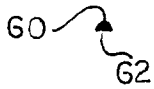
FIG. 5 is a sectional view on line 5—5 of FIG. 4.

Greeting card 46 can be used by itself as shown in FIG. 6, in which case hole 44 can be left out, or may be combined, as shown in FIG. 7, with a balloon 50 having a stem 52 terminating in an open end 53, a hollow tube 54 such as a drinking straw and clip means including two clip members 56. Balloon 50 is shown uninflated in FIG. 2, tube 54 is shown in FIG. 3, and one clip member 56 is shown in FIGS. 4 and 5. If desired, balloon 50 can be provided with a message.

The two clip members 56 may be identical, each being of one piece construction of suitable plastic material. Each member 56 has a body portion 58 and an elongated shank portion 60 depending therefrom. Stem portion 60 is half round, having a flat face 62. When two members 56 are placed with flat faces 52 in confronting engagement with each other, shank portions 60 are insertable into one end of tube 54. Body portions 58 are generally heart shaped, although other attractive configurations may be employed. Shank portions 60 are slightly resilient, such that with shank portions 60 held together, body portions 58 can be slightly flexed apart. Body portions 58 are provided with round aperatures 64 therethrough.

Figure 8:
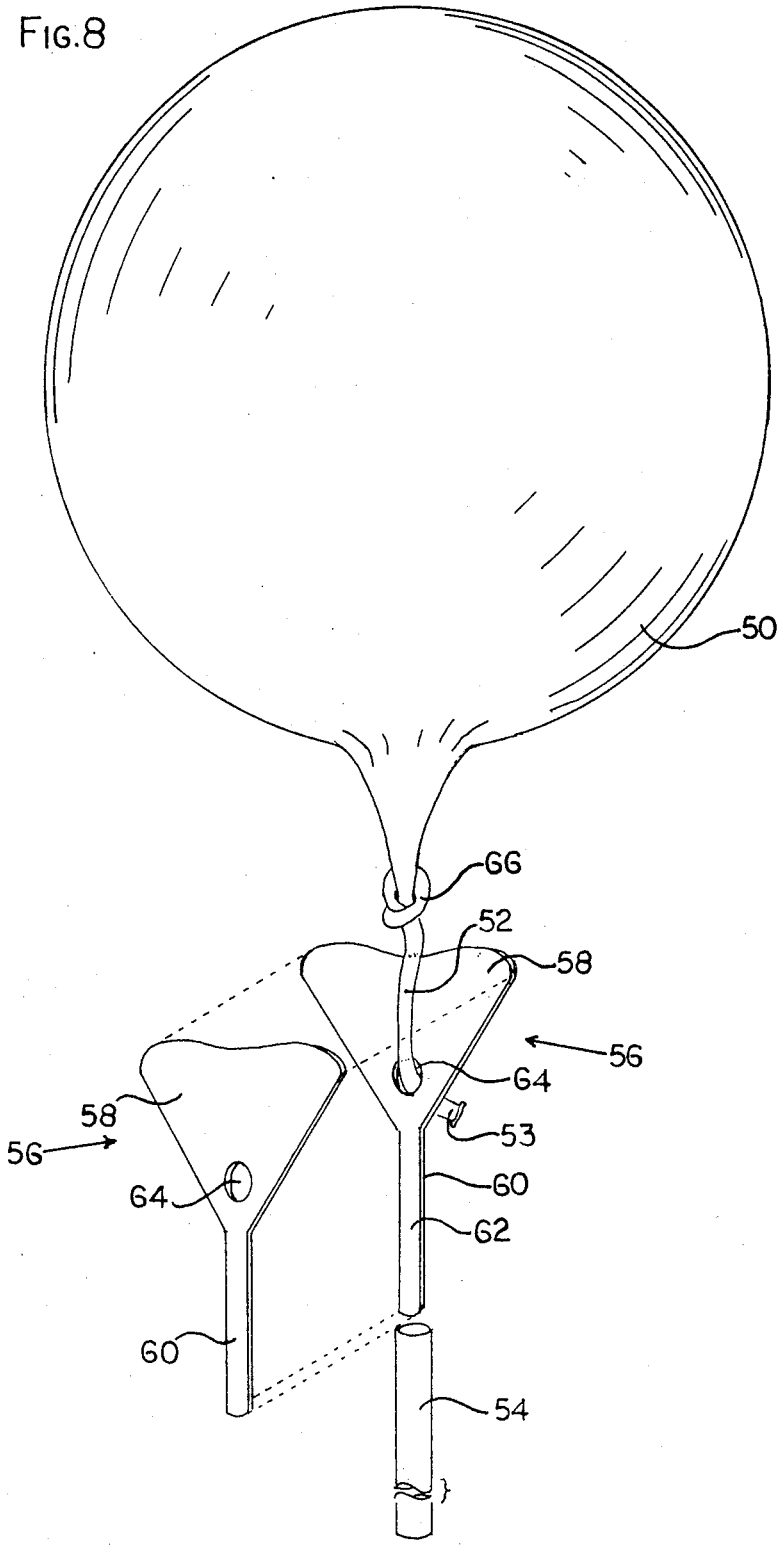
FIG. 8 is a view showing the manner of assembly of the balloon, the hollow tube and the clip means.

The assembly steps described in this paragraph may most readily be understood with reference to FIG. 8. After blank 12 has been converted into self-standing greeting card 46, balloon 50 is inflated and a knot 66 is tied in stem 52. Open end 53 is passed through aperture 64 of the first clip member 56, entering aperture 64 from the end thereof correspondingly to flat face 62. The second clip member 56 is brought into registry with the first clip member 56 with flat faces 62 of shank portions 60 in confronting engagement with each other and with body portions 58 confronting each other and slightly flexed apart by the presence of balloon stem 52 therebetween. One end of tube 54 is then slid over shank portions 60 and balloon stem 52 is pulled downwardly until balloon 50 is snugly held by clip members 56, possibly with knot 66 between clip member body portions 58, and increasing the flexure of body portions 58 away from each other. Tube 54 is then inserted into hole 44 of card 46, until the other end of tube 54 rests on panel 28, thus completing the balloon-greeting card combination.

Greeting card blank 10, balloon 50, hollow tube 54 and clip members 56 can readily be mailed in a standard shaped envelope (not shown), without paying excess postage and can be readily converted by the recipient into an attractive assembly of greeting card 46, balloon 50, hollow tube 54 and clip members 56, or, as mentioned above, balloon 50, tube 54 and clip members 56 can be omitted, in which event, greeting card 46 is usable by itself and hole 44 could be omitted. Furthermore, the location of hole 44 is not critical. For example, it could be centered on fold line 24.

It is evident that the invention attains the stated objects and advantages and others.

The disclosed details are exemplary only and are not be taken as limitations on the invention execept as those details may be included in the appended claims.

What is claimed is:

1. In combination, a greeting card blank comprising a generally rectangular piece of card stock having first and second ends and first and second sides and first, second and third spaced fold lines parallel to said ends, said first end and said first fold line defining a first panel, said first and second fold lines defining a second panel, said second and third fold lines defining a third panel and said third fold line and said second end defining a fourth panel, said first panel having a slot therethrough and spaced from said first end and said first fold line and said blank further having a tab projecting from said second end and interengageable with said slot, said blank being convertible to a self-standing greeting card by folding said blank along said fold lines and inserting said tab into said slot in interengaging relationship therewith, and with said first and fourth panels overlapping each other, and said second panel providing a bottom panel and said third panel providing a front panel, said blank further including a round hole therethrough closely adjacent said third fold line, an uninflated balloon having a stem, a hollow tube and clip means for engaging said tube and said balloon stem after inflation of said balloon, whereby said greeting card blank, upon conversion thereof to a self-standing greeting card can receive said tube through said hole with said clip means engaging said tube and said balloon stem, after inflation of said balloon, whereby said card furnishes a stand for said balloon.

2. In combination, a greeting card blank comprising a rectangular piece of card stock having first and second ends and first and second sides and first, second and third spaced fold lines parallel to said ends, said first end and said first fold line defining a first panel, said first and second fold lines defining a second panel, said second and third fold lines defining a third panel and said third fold line and said second end defining a fourth panel, said first panel having a slot therethrough and spaced from said first end and said first fold line and said blank further having a tap projecting from said second end and interengageable with said slot, said blank being convertible to a self-standing greeting card by folding said blank along said fold lines and inserting said tab into said slot in interengaging relationship therewith, and with said first and fourth panels overlapping each other, and said second panel providing a bottom panel and said third panel providing a front panel, said blank further including a hole therethrough centered on the longitudinal centerline of said blank and closely adjacent said third fold line, an uninflated balloon having a stem, a hollow tube and clip means for engaging said tube and said balloon stem after inflation of said balloon, whereby said greeting card blank, upon conversion thereof to a self-standing greeting card can receive said tube through said hole with said clip means engaging said tube and said balloon stem, after inflation of said balloon, whereby said card furnishes a stand for said balloon, and wherein said clip means comprises first and second clip members each having a body portion and a half round shank portion depending from said body portion and having a flat face, whereby said shank portions of said clip members are insertable into an end of said tube with said flat faces in registry with each other, said body portion of said first clip member having an aperture therethrough for receiving therethrough said stem of said balloon, with said stem of said balloon passing between said body portions.

3. The invention according to claim 2 wherein said clip members are resiliently flexible, so that said body portions will resiliently grip said balloon stem therebetween.

4. The invention according to claim 2 wherein said clip members are identical.

5. The invention according to claim 2 wherein said body portions are generally heart shaped.

6. Clip means for mounting a balloon on a hollow tube, said clip means comprising first and second clip members each having a body portion and a half round shank portion depending from said body portion and having a flat face, whereby said shank portions are insertable into an end of the tube with said flat faces in registry with each other, said body portion of said first clip member having an aperture therethrough for receiving therethrough the stem of the balloon, with said stem passing between said body portions.

7. In combination, an uninflated balloon having a stem, a hollow tube and clip means for mounting said balloon on said hollow tube with said balloon inflated, said clip means comprising first and second clip member each having a body portion and half round shank portion depending from said body portion and having a flat face, whereby said shank portions are insertable into an end of said tube with said flat faces in registry with each other, said body portion of said first clip member having an aperture therethrough for receiving therethrough said stem of said balloon, with said stem passing between said body portions.

* * * * *